United States Patent [19]

Tremblay

[11] Patent Number: 4,800,473

[45] Date of Patent: Jan. 24, 1989

[54] VENITIAN BLIND LAMP

[76] Inventor: Denis Tremblay, P.O. Box 549, Succ. C, Montreal, Canada, H2L 4K4

[21] Appl. No.: 69,976

[22] Filed: Jul. 6, 1987

[51] Int. Cl.[4] ..... F21V 17/02; F21V 17/06

[52] U.S. Cl. ..... 362/217; 362/279; 362/325

[58] Field of Search ..... 362/217, 277, 279, 325, 362/283

[56] References Cited

U.S. PATENT DOCUMENTS

| | | | |
|---|---|---|---|
| Re. 27,125 | 5/1971 | Steel | 362/279 |
| 188,700 | 3/1877 | Von Otter | 362/279 |
| 2,586,625 | 2/1952 | Downey | 362/217 |
| 3,548,186 | 12/1970 | Brock | 362/325 |

FOREIGN PATENT DOCUMENTS

| | | | |
|---|---|---|---|
| 826733 | 4/1938 | France | 362/325 |

*Primary Examiner*—Andrew M. Dolinar

[57] ABSTRACT

A lamp comprising an open main frame interconnecting a cover and a base, an elongated incandescent light tube frictionally mounted at one end to the cover and at the other end to the base, and a plurality of rectangular louvers mounted at their top and bottom ends to the cover and base respectively by corresponding pivotal rods, and arranged in concentric fashion around the light tube. Each louver is lengthwisely pivotable in increments between an opened position, about a plane radial to the light tube, and a closed position, in which the two long side edge portions thereof overlap corresponding portions of the pair of opposite adjacent louvers to completely block light. An annular gear is rotatably mounted within an annular cavity of the lamp base, and meshes with pinions each fixed to the bottom pivotal rod of each louver. Hand-operated synchronous pivotal action of the louvers is thus possible by rotating the annular gear.

14 Claims, 4 Drawing Sheets

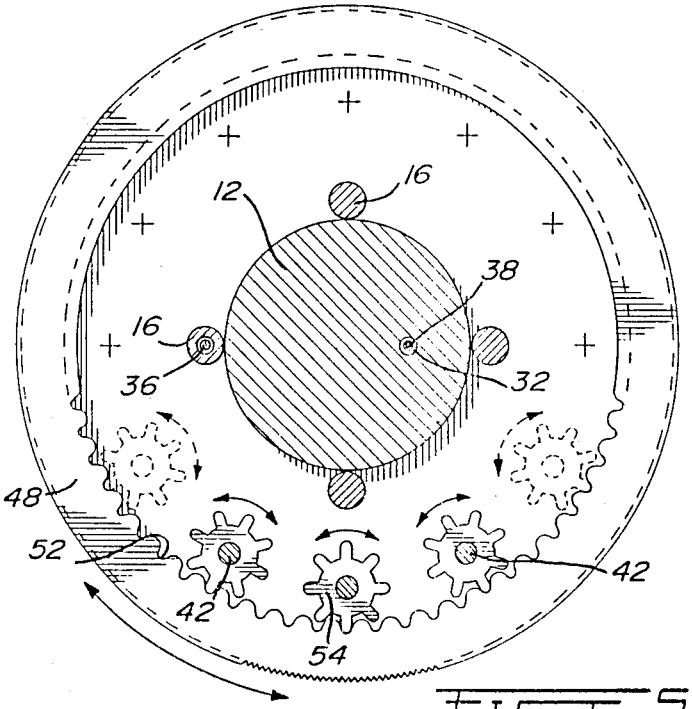
FIG. 5
FIG. 6
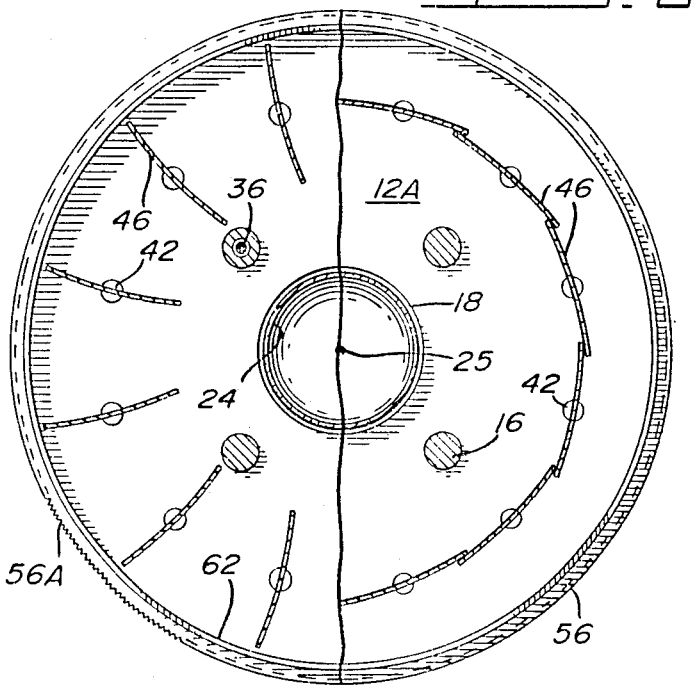

VENITIAN BLIND LAMP

FIELD OF THE INVENTION

The invention relates to devices adapted to vary the level of illumination from a light source.

BACKGROUND OF THE INVENTION

It is desirable to be able to monitor, in some cases,the luminosity of a source of light, for example in a dining room during tea time.

It is known to provide pivotal louver means, surrounding the light bulb, for monitoring the desired amount of light allowed to escape therethrough. Various models thereof have already been proposed, e.g. U.S. Pat. Nos. 3,275,820 for automobile headlights, or U.S. Pat. No. 3,598,988 for a lamp hanging from a ceiling chain. One drawback of such light-intensity monitoring means is the means to actuate pivotal action of the louvers , said actuating means often being inefficient and/or structurally complex.

OBJECTS OF THE INVENTION

The main object of the invention is to provide the design of known pivotal louvers means monitoring the light-intensity generated by sources of light.

A more specific object of the invention is to provide a decorative table lamp in which the louver means provide a pleasant illuminating effect.

Still another object of the invention is to provide a louver means designed for use with an incandescent or fluorescent light tube, so that the lamp can be hung from a ceiling, fixed to a wall, or used as a table lamp.

SUMMARY OF THE INVENTION

A lamp comprising a bottom frame, a top frame, a connector member spacedly rigidly interconnecting the top and bottom frames, a light-emitting member, mounting means to secure said light-emitting member between said top and bottom frames, a plurality of first pivot members mounted to said top frame and a plurality of second pivot members mounted to said bottom frame, each first pivot member vertically registering with a corresponding one of the second pivot members, said pivot members in circular arrangement concentrically to the position of said light-emitting member, a plurality of quadrangular louvers each supported at their top and bottom ends by a pair of registering said first and second pivot members; and actuating means,to incrementally pivot said louvers between an opened position, in which each louver defines a radial plane relative to said light-emitting member, and a closed position, in which the side edge portions of adjacent louvers overlap one another so as to define a substantially opaque cylindrical partition.

The actuating means may include an annular gear, an annular channel in said bottom frame concentric with said light-emitting member and rotatably engaged by said annular gear, each said second pivot member comprising a rod secured to one of said louvers and having a bottom end extending into said annular channel, and gear means secured to said bottom end and meshing with said annular gear, whereby rotation by a fraction of a turn of the annular gear rotates all said rods by the same angular value and thus pivots all said louvers by a same angular value.

BRIEF DESCRIPTION OF THE DRAWINGS

FIG. 5 is a partly schematic cross-sectional elevation of the above-mentioned lamp, taken along line 5—5 of FIG. 4; and FIG. 6 is a cross-sectional view of the lamp taken along line 6—6 of FIG. 4, showing said louvers in opened position on the left half side of the figure and in closed position on the right half side thereof.

DETAILED DESCRIPTION OF THE PREFERRED EMBODIMENT OF THE INVENTION

Figure 1:
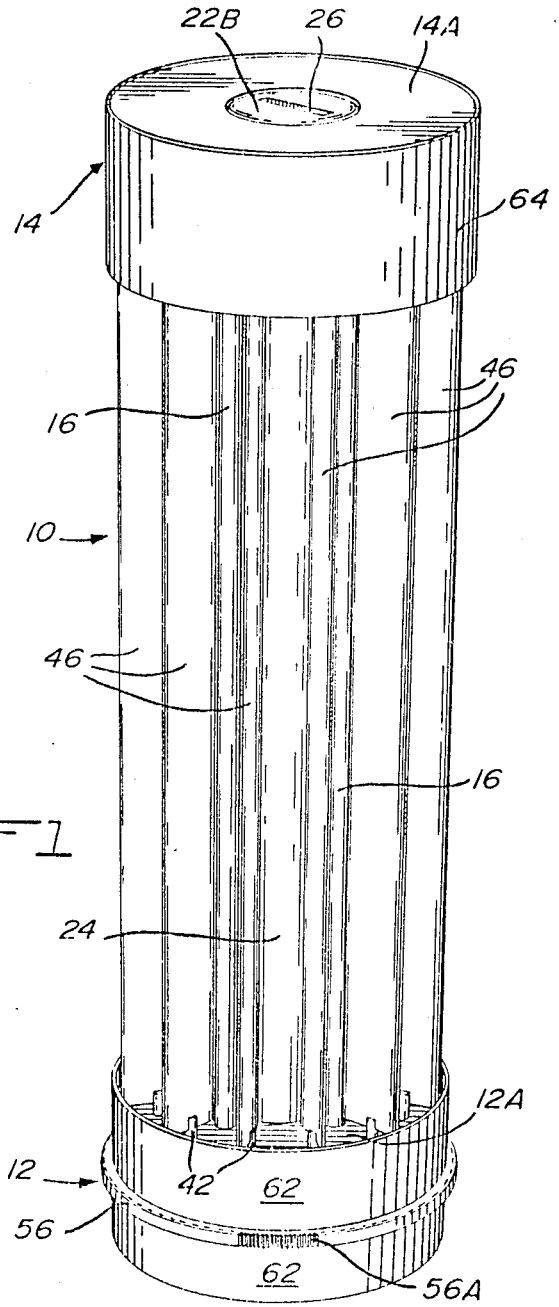
FIG. 1 and 2 are perspective views of a lamp constructed in accordance with the teachings of the invention, the pivotally adjustable louvers thereof in opened and closed position respectively.

A preferred embodiment of lamp according to the invention is designated by numeral 10. Lamp 10 consists of a bottom base member 12, a top cover 14, both base 12 and cover 14 being similar substantially full cylinders and spacedly rigidly releasably interconnected by four elongated connector rods 16 which are press fitted within bores of base 12 and cover 14. Base 12 and cover 14 are preferably made of wood such as wild cherry tree. Rods 16 are mounted, relative to a virtual axis interconnecting the centers of cylindrical base 12 and cover 14, concentrically thereto and angularly equally distributed. Base 12 includes a central cavity 18 on its top face 12A, a circular metallic cup 19 lodged therein. Cover 14 includes a central through-bore 20, provided with a spiralling or threaded peripheral wall portion 21 for engagement by a screw plug 22. Plug 22 includes a flat inner end face 22A.

An elongated incandescent tube 24 is provided, tube 24 including top and bottom slightly tapered metallic ends 24A, 24B, interconnected by an inner filament 25 which emits light if an electrical current passes therethrough.

To install tube 24 into lamp frame 12–16, tube 24 is lowered through bore 20, so as to be lodged at its bottom end 24B into cavity 18 and at its top end 24A into bore 20; plug 22 is then screwed whereby plug end face 22A, which is slightly involuted, flatly abuts against the top end 24A of tube 24, to frictionally releasably secure same to the frame assembly 12-16.Plug bottom end face 22A and cup 19 thus conform to the shape of tapered tube ends 24A, 24B,respectively.

Plug 22 defines an enlarged head 22B having a central slot 26 for engagement by a screwdriver, to screw/unscrew the plug into bore 20. The upper portion of bore 20, at 20A, is accordingly widened to allow therethrough head 22B.Plug 22 may be of such dimensions that its top face 22C is flush with the top face 14A of cover 14 when seat 22A abuts against the top end 24A of tube 24.

The body of plug 22, except its head 22B, is surrounded by a metallic sheath 28. Threaded bore portion 21 also includes a metallic covering layer 29. Cup 19 is also metallic. Rods 16 are hollow, and one of them, 16A, communicates both with bore 20, through an elbowed channel 30 in cover 14, and with cavity 18, through a passageway 32 into base 12. Passageway 32 also opens laterally of base 12 at its other end, for engagement by an electric wire 34. It can now be understood that one wire 36 of the electric cord 34 is engaged through hollow rod 16A and into channel 30, to electrically connect with the metallic sheaths 28 and 29 and thus with tube top end 24A. Similarly, the other wire 38 of cord 34 is engaged further on in passageway 32 to electrically connect with cup 19 and thus with the tube bottom end 24B. Hence,when cord 34 is connected to a wall plug, light will be produced by tube 24, provided plug 22 is tightly screwed to the position of FIG. 4 so that seat 22A abut against the tube top end 24A.

In accordance with the heart of the invention, a plurality of short rods 40, 42, are provided, extending halfway through the peripheral portion of the cover bottom face 14B and of the base top face 12A, respectively, each rod 40 vertically registering with one corresponding rod 42. Rods 40, 42, project toward each other and are freely rotatable within cover 14 and base 12. A free end portion of the projecting section of each rod 40,42, is longitudinally slotted, at 44. The slots 44 of each registering pair of rods 40, 42, are engageable by the ends of an elongated rectangular louver 46, whereby the opposite ends of the latter are rotatable slightly spacedly from base 12 and cover 14. Louvers 46 are preferably made of aluminum.

The width of each louver 46 is smaller than the radial distance between the periphery of tube 24 and that of cover 14 and base 12. As suggested in FIG. 6, in their radial position, louvers 46 should extend short of the circular level of frame rods 16. Louvers 46 are rotatable between a radial opened position, shown at the left side of FIG. 6, to a closed position shown at the right side of FIG. 6.

Figure 2:
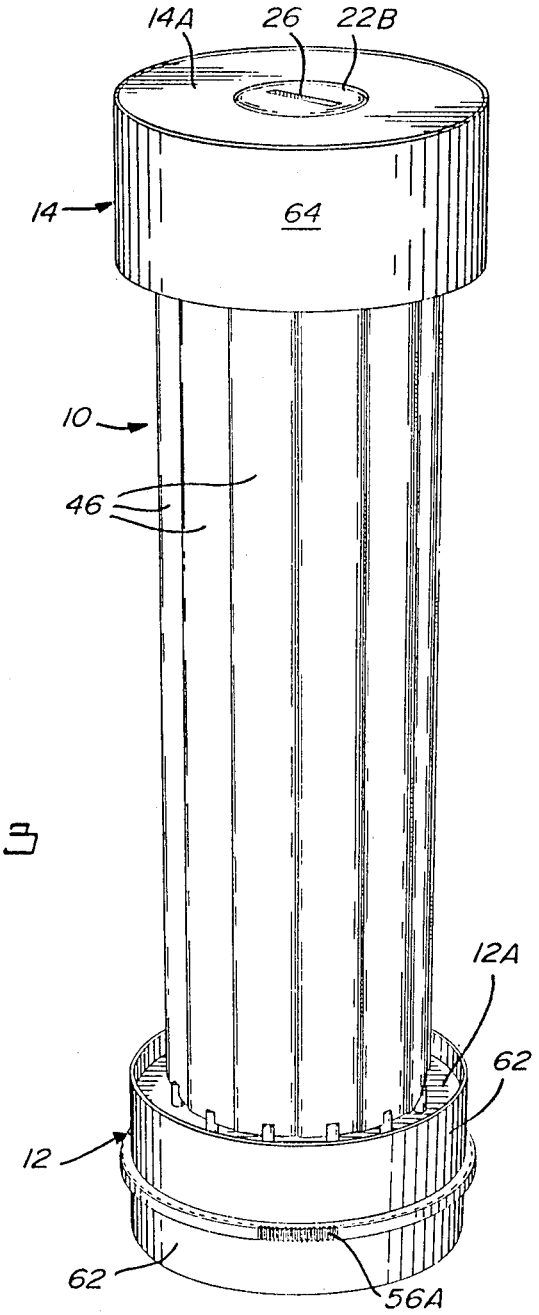

Louvers 46 and associated pivot rods 40, 42, are in such number that, in their closed position, louvers 46 define a substantially circular closed wall, see FIGS. 2 and 6 to the right, wherein the clockwise longitudinal edge portion of any given louver abuts against the outer face of the counterclockwise longitudinal edge portion of the clockwisely-following louver. Hence, in their closed position, louvers 46 completely mask the light coming from incandescent light tube 24, but for top and bottom thin beams of light about the small spacing between louvers 46 and base 12 and cover 14, see FIG. 4.

In their fully opened position, louvers 46 extend radially relative to tube filament 25, so that light produced by tube 24 be at a maximum level. Of course, any intermediate position of louvers 46 is possible, with associated relatively reduced level of illumination.

Each louver 46 preferably has a small camber or concavity, as shown in FIG. 6. The radius of curvature of the louvers 46 is about that of cylindrical base and cover 12, 14.

Means are further provided both to lock each louver 46 in a given position relative to the other louvers, and to concurrently rotate all the louvers with a single finger of a hand. Such means includes a large annular flat gear 48, provided at the radially outward portion of a corresponding annular cavity 50 made concentrically to cavity 18 at an intermediate section of base 12 to accommodate gear 48. Gear 48 is also preferably made of aluminum. The radially inward edge of annular gear 48 forms gear teeth 52. The bottom end of each bottom rod 42 extends into cavity 50, and is integrally mounted to a small pinion 54. Pinions 54 are coplanar with annular gear 48 and adapted to mesh with its teeth 52. The radially-outer edge 56 of annular gear 48 projects radially outwardly of base 12, so as to be accessible to an operator's hand. Outer edge 56 is preferably knurled at 56A, to facilitate gripping action thereabout with a single finger.

Thus, when annular gear 48 is rotated by an increment of a turn, each louver 46 is pivoted about its longitudinal axis by a corresponding angular increment (which is the same with any other of the louvers 46). Hence, the apparent candle-light power of the lamp 10 is accordingly adjusted with the rotation of gear 48 and thus of louvers 46.

Due to its simplicity in design, the lamp 10 can be disassembled or reassembled in about five minutes. The lamp can be positioned on a table, against a wall, or hung to a ceiling.

Figure 3:
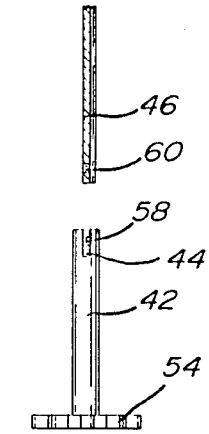
FIG. 3 is an elevation of a lamp base pivotal rod and associated pinion of one of the above mentioned-louvers, and of a louver in fragmentary sectional view.

As shown in FIG. 3, a small semi-circular projection or pin 58 is mounted to each pivot rod 42, within an intermediate section of slot 44. The pin 58 extends transversely of the slot 44 by about half the width of the latter. Louver 46 is thinner than said width of pivot rod slot 44, and includes a small transverse bore 60 at its bottom end portion. Rod 42 is made of a semi-resilient thermoplastic material, so that upon engagement of the bottom leading edge portion of slat 46 into slot 44, pin 58 will temporarily yieldingly retract until it registers with bore 60, into which it will thereafter releasably lockingly engage.

Base 12 further includes an annular outer flange or wall 62, extending upwardly beyond the level of base top wall 12A, to shield the lower portion of louvers 46 and to prevent light emission through the gap between louvers 46 and base 12. Cover 14 similarly includes an annular flange 64, extending downwardly beyond the level of cover bottom wall 14B, for the same purpose as shield 62.

Figure 4:
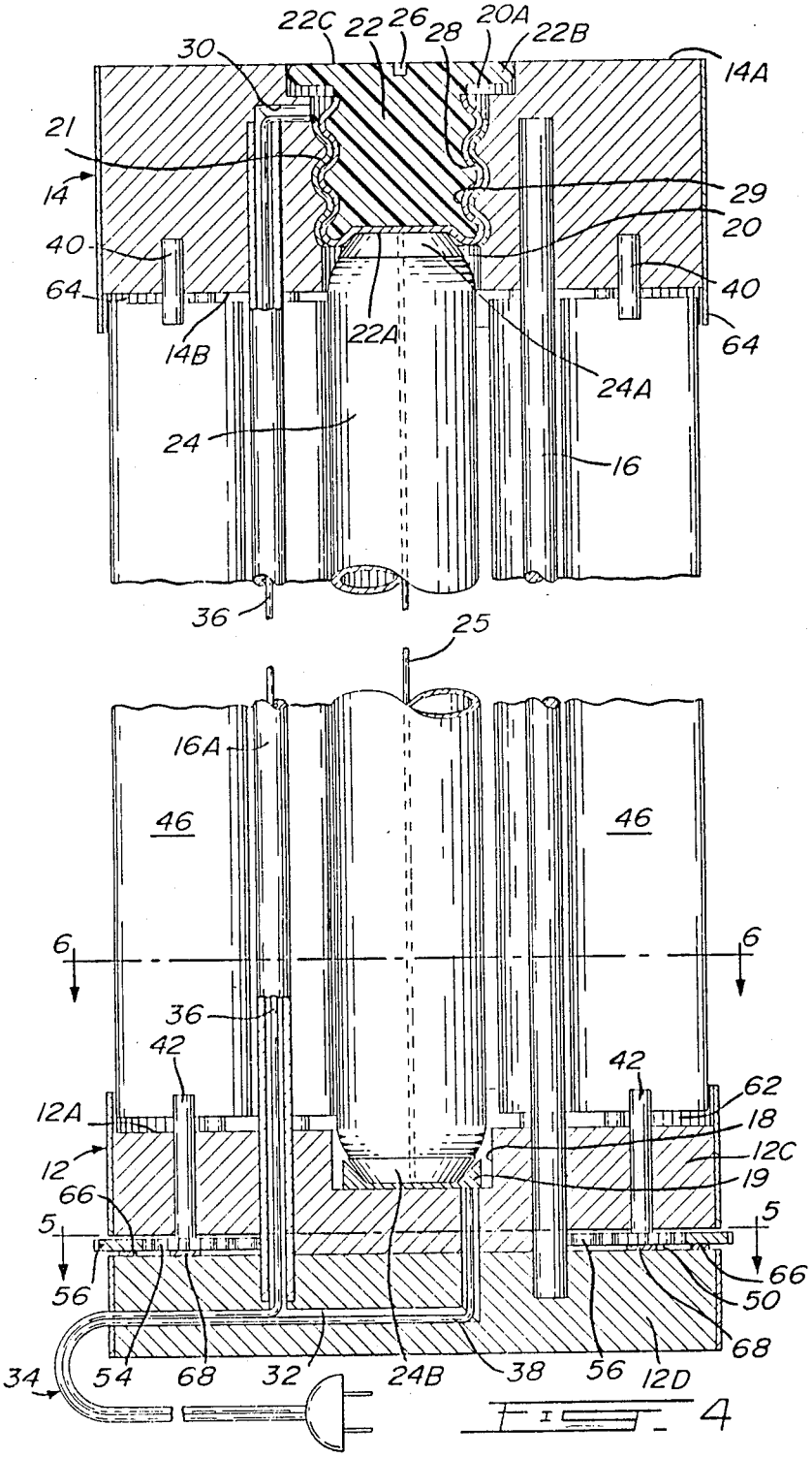
FIG. 4 is a fragmentary partly sectional elevation of the above-mentioned lamp.

As shown in FIG. 4, a first large washer 66 is anchored to the floor of annular cavity 50, in register with annular gear 56, to facilitate sliding motion of the latter thereover. Similarly, a second large washer 68, diametrically smaller than O-ring 66, is anchored to the floor of annular cavity 50, in register with the level of pinions 54, to facilitate rotation of the latter thereover.

To facilitate assembly and disassembly of the parts , base 12 is made in two sections as shown at 12C, 12D, in Figure 4.

Obviously, incandescent lamp 24 could be replaced by a fluorescent lamp and the electric circuit and terminals modified accordingly.

It should be noted that the louvers will not completely surround the lamp 24 in the case the assembly is used for instance as a ceiling lighting fixture, wherein the louver system will replace the light scattering translucent panel of the conventional lighting fixture. In such an application, the means for simultaneously pivoting the louvers can be driven by a remote-controlled electric motor.

I claim:

1. A lighting fixture comprising spaced first and second frames, a connector member spacedly rigidly interconnecting said frames, a light-emitting member extending between said frames, mounting means to secure said light-emitting member to said frames, a plurality of first pivot members mounted to said first frame and a plurality of second pivot members mounted to said second frame, each first pivot member coaxial with a corresponding one of the second pivot members, said pivot members at least partially spacedly surrounding said light-emitting member, a plurality of quadrangular louvers each supported at its ends by a pair of coaxial first and second pivot members; and actuating means, to incrementally pivot said louversd between an opened position, in which said louvers are substantially parallel, and a closed position, in which the side edge portions of adjacent louvers overlap one another so as to define a substantially opaque partition.

2. A lamp as in claim 1, wherein said louvers are rectangular and each defining a slight transverse camber forming a virtual circle of arc substantially concentric with said light-emitting member in said louvers closed position.

3. A lamp comprising top and bottom frames forming substantially full cylindrical blocks, a connector member spacedly rigidly interconnecting the top and bottom frames, a light-emitting member consisting of an elongated light tube chosen from the group consisting of incandescent and fluorescent tubes, and longitudinally extending between the top and bottom frames; power input means, to feed said light tube; mounting means to secure said light-emitting member between said top and bottom frames, a plurality of first pivot members mounted to said top frame and a plurality of second pivot members mounted to said bottom frame, each first pivot member vertically registering with a corresponding one of the second pivot members, said pivot members in circular arrangement concentrically to the position of said light-emitting member, a plurality of quadrangular louvers each supported at their top and bottom ends by a pair of registering said first and second pivot members; and actuating means to incrementally pivot said louvers between an opened position, in which each louver defines a radial plane relative to said light-emitting member, and a closed position, in which the side edge portions of adjacent louvers overlap one another so as to define a substantially opaque cylindrical partition; said actuating means including an annular gear, an annular channel in said bottom frame concentric with said light-emitting member and rotatably engaged by said annular gear, each said second pivot member comprising a rod having a bottom end extending into said annular channel, and gear means secured to said rod bottom end and meshing with said annular gear, whereby rotation by a fraction of a turn of the annular gear rotates all said rods by the same angular value and thus pivots all said louvers by a same angular value.

4. A lamp as in claim 3, wherein said annular gear is radially outward of said pinions with internal gear teeth.

5. A lamp as in claim 3, wherein said louvers are rectangular, each defining a slight transverse camber forming a virtual circle of arc substantially concentric with said light tube in said louvers closed position.

6. A lamp as in claim 3, wherein said gear means are disc-shaped pinions having external teeth, said annular gear being radially outward of said pinions and having on its interior face a number of teeth adapted to engage said pinions teeth during rotation of the annular gear.

7. A lamp as in claim 6, wherein the radially outward edge of said annular gear extends radially-outwardly from said bottom frame and includes a knurled section, for facilitating handgripping action thereabout.

8. A lamp as in claim 7, further including first and second washers, concentrically anchored to said bottom frame annular channel,in underlying register with said annular gear and with said pinions, respectively.

9. A lamp as in claim 3, wherein said top and bottom frames further include annular flanges extending one toward the other beyond their respective inner faces.

10. A lamp as in claim 3, wherein said top frame includes a central through-bore engageable by said elongated light tube, for releasably positioning the latter between the frames centrally thereof.

11. A lamp as in claim 10, wherein said through-bore is threaded; said mounting means characterized in that the top face of said bottom frame includes a central cavity; a screw plug is further provided, to screwingly engage said through-bore so as to abut against the light tube top end to lockingly push the light tube bottom end into said bottom frame central cavity.

12. A lamp as in claim 11, wherein said power input means includes: a metallic cup, mounted into said bottom frame central cavity, a metallic sheath surrounding the body of said screw plug, said cup and sheath in electrical contact with said light tube ends for connection to an A-C power source.

13. A lamp as in claim 12, wherein said connector member includes at least a pair of rigid rods, radially outward of said light tube, and radially inwardly of the radially inward side edge portion of said louvers when in the opened position thereof.

14. A lamp as in claim 13, wherein one of said connector rods is hollow, said top frame including one passageway interconnecting said hollow rod to said top frame through-bore, said bottom frame including another passageway interconnecting said hollow rod and said bottom frame central cavity and opening to the outside of said bottom frame, one electrical wire passing through said hollow rod and said one passageway to electrically connect with said plug sheath, another electric wire passing through said another passageway to electrically connect with said cup, said electric wires adapted to be connected at their outer ends to an A-C wall plug outlet.

* * * * *